United States Patent [19]

Salomon

[11] 4,078,828

[45] Mar. 14, 1978

[54] SKI BINDING

[75] Inventor: Georges Pierre Joseph Salomon, Aneccy (Haute-Savoie), France

[73] Assignee: Etablissements Francois Salomon et Fils, Annecy (Haute-Savoie), France

[21] Appl. No.: 677,292

[22] Filed: Apr. 15, 1976

[30] Foreign Application Priority Data

Apr. 23, 1975 France ..... 75 12647

[51] Int. Cl.[2] ..... A63C 9/08

[52] U.S. Cl. ..... 280/625

[58] Field of Search ..... 280/625, 630

[56] References Cited

U.S. PATENT DOCUMENTS

| | | | |
|---|---|---|---|
| 3,584,891 | 6/1971 | Khazzam | 280/625 |
| 3,734,521 | 5/1973 | Payrhammer | 280/625 |
| 3,822,071 | 7/1974 | Mottet | 280/625 |

*Primary Examiner*—Robert R. Song

[57] ABSTRACT

The device comprises two jaws hinged about an axle and subjected to the restoring action of a spring towards the closed position of these jaws onto a boot; a stop, integral with each jaw is adjacent its dead point in relation to the axle and is located on the other side of the longitudinal axis of the device. This arrangement reduces friction and permits effective return to the operative position whenever a load is insufficient to cause the boot to be released.

7 Claims, 4 Drawing Figures

SKI BINDING

The invention relates to an improvement to a device for binding the front part or toe of a boot to a ski equipped with a conventional "heel-piece".

Devices for binding the toe of a boot to a ski are already known and consist essentially of two jaws designed to grip the forward part of the lateral edges of the sole of a boot, and two stops or supports taking the forward thrust of the toe of the boot produced by the conventional action of the heel-piece; when at rest, the jaws are urged towards a predetermined location by means of a resilient element, such as a spring.

In certain designs of devices of this kind, each stop (or support) is integral with an arm constituting a jaw hinged to a mounting on the ski, for the purpose of obtaining a mobile stop (or support), the movements of which are a function of the movements of arm thereof.

An object of the present invention is a device of this kind, having a jaw integral with a stop (or support) hinged to a mounting on the ski, but subjected to the restoring action of a resilient element towards a position in which the jaws are closed onto the boot.

A device of this kind is characterized in that each stop (or support) is adjacent its dead-point location in relation to its hinge axis, and is located, in relation to its arm, on the other side of the central longitudinal axis of the mounting on the ski.

As a result of this arrangement, each of the stops (or supports) is displaced by its arm, from its position of rest, in the direction of the return movement of the boot, so that in the event of a load tending to produce a "release", the boot is well supported by this mobile stop (or support), which frees the other stop (or support), reduces friction, and allows the resilient element bearing against the sole to assure an effective return to the position of use, if the load is not high enough to produce a "release" of the boot.

According to a preferred embodiment of the invention, the hinge axes of the two jaws are merged, and a resilient element acts, in the direction of closing, upon appropriate parts of each arm, through the arms of a forked tappet.

A design of this kind obviously provides simple assembly, with a relatively small number of components, but is nevertheless remarkably rugged.

The present invention will be better understood by referring to the drawings attached hereto and showing, purely by way of example, a preferred form of execution thereof. In the drawings.

Figure 1:
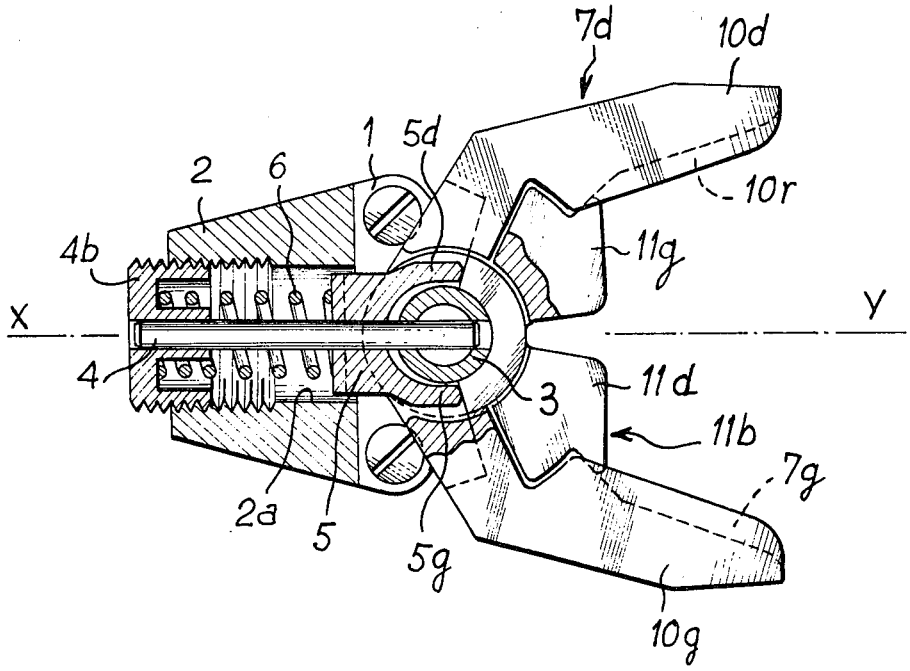
FIG. 1 is a plan view, in partial horizontal section, of a device according to the invention.

FIG. 1 shows a rigid plate 1 comprising two holes for attachment to the ski with two screws. The free surface of the plate is integral with a boss 2 comprising a bore 2*a*, the geometrical axis of which is parallel with plate 1; the plate and boss 2 have a common central plane of symmetry X, Y, upon which the axis of the boss is located, and on each side of which are located the two screw holes. This plane X, Y therefore passes through the longitudinal axis of the ski, when the device is fitted thereto.

An axle 3, the diameter of which is relatively large in relation to its length and to the dimensions of plate 1, is arranged perpendicularly and is secured rigidly to the part on the free face of plate 1 facing boss 2, its geometrical axis being also located on the plane of symmetry X, Y.

This axle 3 has a transverse hole coaxial with bore 2*a* and adapted to engage, with moderate friction, with one end of a rigid rod 4 of circular cross section, the other end of which engages in a circular hole drilled axially in an element 4*b* in the form of a plug which is screwed into bore 2*a*, the plug being threaded and the bore being tapped accordingly.

A forked element 5, having two identical arms 5*d*, 5*g* separated by a distance somewhat greater than the diameter of axle 3, is fitted centrally to rod 4 and is welded thereto, with arms 5*d*, 5*g* located on each side of the axis.

Finally, a compression spring 6, consisting of a piece of wire usually wound into a coil, is fitted onto rod 4, the ends of the spring bearing respectively against the inside face of plug 4*b* and against the back of fork 5.

Furthermore, two similar elements 7*d*, 7*g* are mounted to pivot upon axle 3, as explained hereinafter.

Each of these elements, element 7*d* for example (FIG. 2), comprises a rigid ring 8 of complex shape, the bore in which is adapted to swivel on axle 3. An arm 9 exhibiting, as a whole, a somewhat oblique arrangement in relation to one radial direction of ring 8, is integral therewith and is extended by an arm 10*d*, the relative slope of which is in the same direction as that of arm, but is somewhat greater, arm 10*d* thus forming an obtuse-angled elbow with arm 9.

The end of arm 9 adjacent arm 10*d*, and the latter itself, are substantially thicker than ring 8, enough to accommodate on its upper surface, in the usual way a flange 10*r* designed to cover the toe, or more particularly the edge of the sole of a boot.

The part of ring 8 which, in FIG. 1, faces fork 5 and corresponds to the internal surface of arm 10*d*, is in the form of a part-circular crown which is thicker than the other part of the ring, in order to form a radial surface 8*p* adjacent to arm 10*d* and designed to abut against the end of corresponding arm 5*d* of fork 5. The other end of this crown section forms another surface 11*c* which is either radial or inclined, the dimensions thereof being therefore similar to those of surface 8*p*.

The part of arm 9 located above surface 8*p* has a recess for the engagement and displacement of surface 11*c* integral with the other arm 10*g*; this second surface 11*c* is located above first surface 8*p*, thus constituting a "limit" stop for forked device 5.

A post in the form of a right prism, the generating lines of which are arranged parallel with the geometrical axis of ring 8, is integral with the ring and is in angularly spaced relationship to arm 9.

Figure 2:
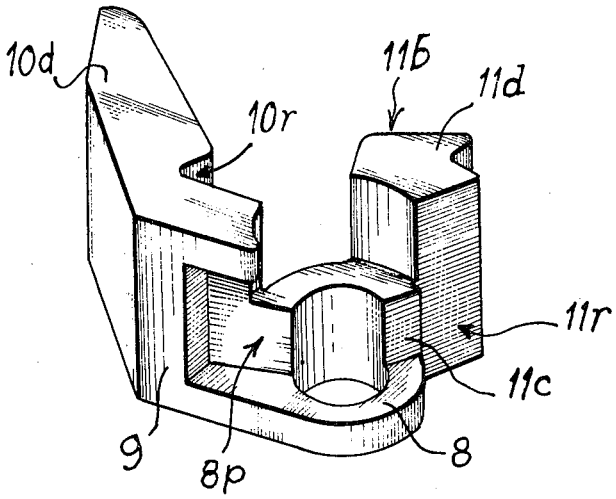
FIG. 2 is a perspective view of an essential component of the device shown in FIG. 1.

This post has an almost radial front surface 11*r* running towards fork 5, the angular position of which may be adapted to that of the rear inside surface of arm 9, so that it comes up against the like surface on arm 7*g*, thus restricting the action of fork 5, as will be explained hereinafter, surface 11*r* being located, in the example shown in FIG. 2, to the rear of surface 11*c*.

Finally, this post has an almost flat rear surface 11*b* remote from ring 8, the dimensions and locations of the various parts of this post, in relation to the dimensions and general directions of arms 9 and 10*d*, being such that surface 11*b*, in the position of rest and in the absence of the boot (FIG. 1), occupies most of the space between arms 10*d*, 10*g* in the vicinity of the plane X, Y, being located on the other side of the plane and in the immediate vicinity of the dead point.

This surface 11*b* may be at a slight angle to the plane X, Y, in order that the sole, the front of which is rounded off, may be supported thereby almost without increasing the thrust on the heel-piece when it pivots, the compression of the heel-piece return springs being due merely to the fact that the point of contact is close to the "dead point".

The other element 7*g* is similar to the element described above, the only difference being the positions of its surfaces 8*p*, 11*c* in relation to arm 10*g* and, therefore, the positions of the areas of contact between these surfaces and the corresponding arm of fork 5.

Furthermore, in the case of each of the two elements 7*d*, 7*g*, the parts of arm 9 facing ring 8 in the direction of thickness, and also the internal surface of each post 11, are in the form of part-bores adapted to engage freely with the corresponding portions of the external lateral surfaces of the other element 7, and vice-versa.

Figure 3:
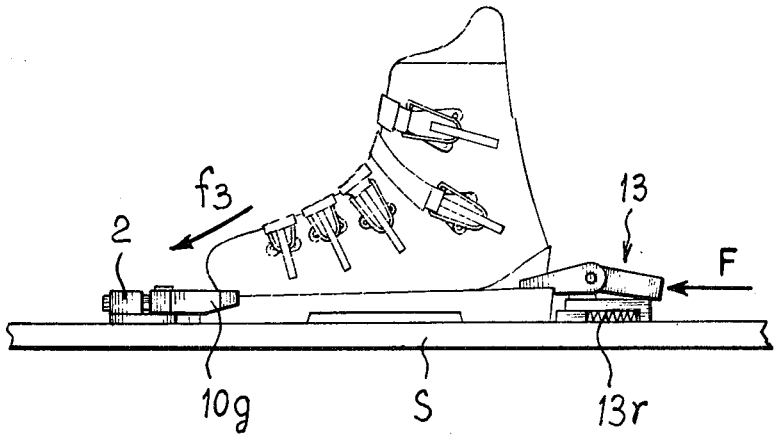
FIGS. 3 and 4 are diagrams making it possible to explain the operation of the device shown in FIG. 1.

It will be understood from the foregoing description that the device described may be mounted upon a ski 12 equipped, in the conventional manner, with a heel-piece 13 of the type having a "return spring" 13*r* (FIG. 3).

It may be gathered that, in the position of rest, arms 10*d*, 10*g* have moved towards each other (arrow *f*1) due to the action of the arms of fork 5 upon their respective stops 8*p* and to the force of spring 6 (arrow *f*2), the force being adjustable by rotating plug 4*b* in the appropriate direction, the distance between arms 10*d*, 10*g* being restricted solely by the contact between surface 11*r* of each jaw, thus formed, and the corresponding surface of the other jaw, or by the contact between the central part of fork 5 and axle 3.

Figure 4:
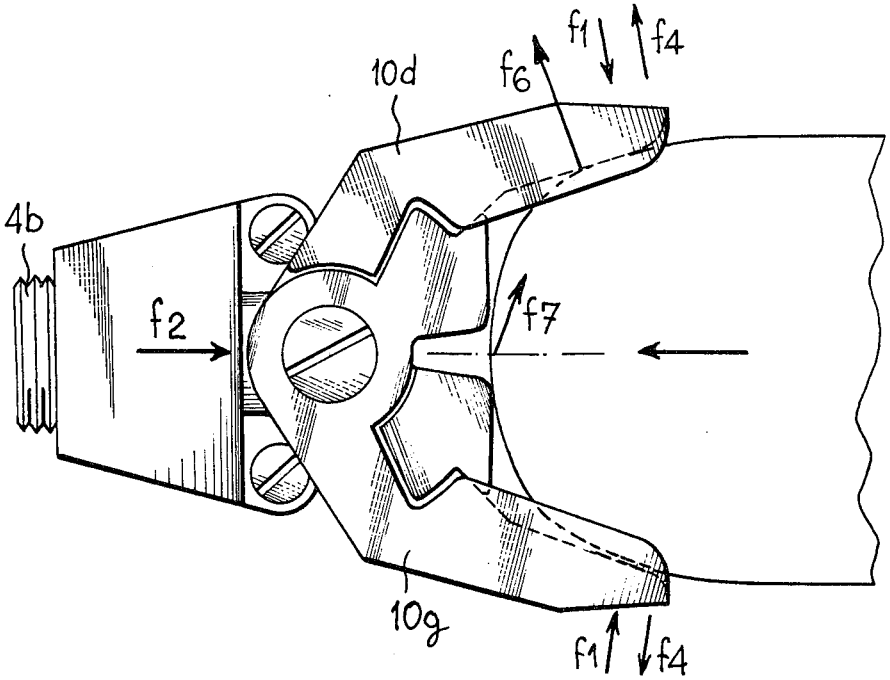

The toe of the boot may thus be engaged between arms 10*d*, 10*g* by pushing the boot forward (arrow *f*3) until it is secured to the ski by the usual cooperation of heel-piece 13 (FIGS. 3 and 4).

This engagement of the toe of the boot is achieved, against the force of spring 6, by spreading arms 10*d*, 10*g* apart (arrow *f*4), which involves a small displacement (away from the dead point) of surfaces 11*b*, against which the boot bears, in order to halt this spreading. The front of the sole of the boot preferably bears against that part of surface 11*b* which is located closest to the plane X, Y.

Each surface 11*b* thus constitutes a mobile stop which absorbs the thrust of the boot, thus rendering any release thereof practically independent of any variations in this thrust arising while the ski is in use, especially any variations due to flexing of the ski, thanks to the action of spring 13*r* (arrow F).

In the event the boot applies a lateral thrust large enough to cause this binding device to release (arrow *f*6), only arm 10*d*, for example, is urged in an outward direction, moving its stop 11*b* towards the longitudinal axis of the ski, and therefore towards the location of its dead point; the effect of this movement (arrow *f*7) is to urge the boot slightly towards the heel-piece.

At the moment of release, therefore, the boot bears solely against this stop 11*b*, the almost flat shape of which is well adapted to provide such support and to limit friction. The other stop on the other jaw 7*g* is not displaced (FIG. 4) by reason of the distance provided between prismatic posts 11*d*, 11*g* in the vicinty of axis X, Y.

In the event the boot applies a lateral thrust against this arm 10*d*, corresponding stop 11*b* also moves towards the heel-piece to provide support in a manner similar to that described above, in order effectively to return the boot towards its normal position upon the ski, under the action of spring 6; the other arm, 10*g*, is also released from the action of the boot and of fork, and may therefore move without offering any resistance.

It will therefore be understood that the combination of the type of jaw described above, with the thrust means just mentioned, provides advantages, when the device is in use, as a result of the special positioning of the stops in relation to the axis of the ski.

It is also clear that manufacture of the device described above involves only quite normal machining operations and a few simple assembly operations.

Finally, the device is rugged, rod 4 being adequately guided by its two ends.

Variations may, however, be applied. For instance, rod 4 may be guided between fork 5 and support plate 1, in which case the radial hole in axis 3, in the direction of plane X, Y, may be eliminated.

Moreover, the description relates to the sole of a boot, whereas certain supports may obviously be provided on the boot upper, without departing from the scope of the invention.

What is claimed is:

1. A device for binding the front part of a boot to a ski fitted with a heel binding element, comprising:

a pair of jaws, each said jaw being in a form of a two armed-lever and each said pair of jaws including means for laterally retaining a boot;

means for pivotally mounting said pair of jaws to a ski, each jaw being pivotable in a plane substantially parallel to the ski; said device having a central longitudinal axis substantially parallel to the central axis of the ski and each said jaw being mounted on each side of said central longitudinal axis; each said jaw including a support against which the boot bears, said support being so located as to prevent an increase of thrust exerted on the heel binding element when the jaw pivots; each said support being also located, with respect to its associated boot retaining means, on the other side of said central longitudinal axis; and resilient means actuating said pair of jaws towards a position in which said jaws are closed onto the boot.

2. A device according to claim 1, wherein said means for pivotally mounting said pair of jaws comprise a vertical oriented pivot axle, each jaw pivoting about said axle.

3. A device according to claim 2 , wherein said resilient means comprise a fork substantially parallel to said central longitudinal axis; said fork having a pair of arms, each arm bearing against at least one stop provided on each said jaw.

4. A device according to claim 2, wherein said jaws comprise mutual stop means for restricting the closing action of said resilient means.

5. A device according to claim 2, wherein a space is provided between parts of said jaws adjacent said central longitudinal axis.

6. A device according to claim 3, wherein said fork comprises a rod having its opposite ends guided longitudinally in two holes provided respectively in said pivot axle and in a plug mounted in a body; said body comprising means for fitting said body on the ski.

7. A device according to claim 6, wherein said resilient means comprise a spring actuating said fork; said plug comprising means for calibrating the compressive force of said spring.

* * * * *